US006925672B1

(12) United States Patent
Bromley

(10) Patent No.: US 6,925,672 B1
(45) Date of Patent: Aug. 9, 2005

(54) LOTION APPLICATION TOOL

(76) Inventor: Darryl L. Bromley, 3038 Essex Rd., Baltimore, MD (US) 21207

( * ) Notice: Subject to any disclaimer, the term of this patent is extended or adjusted under 35 U.S.C. 154(b) by 9 days.

(21) Appl. No.: 10/794,269

(22) Filed: Mar. 8, 2004

(51) Int. Cl.[7] ..... A47K 7/02; A61H 15/00

(52) U.S. Cl. ..... 15/104.94; 15/210.1; 601/129; 601/131; 601/137

(58) Field of Search ..... 15/104.94, 210.1; 601/128, 129, 130, 131, 134, 137

(56) References Cited

U.S. PATENT DOCUMENTS

| | | | | |
|---|---|---|---|---|
| 2,103,261 | A * | 12/1937 | Hughes | 601/154 |
| 2,263,802 | A * | 11/1941 | Grusin | 15/110 |
| 2,285,105 | A * | 6/1942 | Bacher | 601/113 |
| 2,837,756 | A | 6/1958 | Barlow et al. | |
| 2,988,084 | A * | 6/1961 | Douglas | 601/80 |
| 3,994,290 | A * | 11/1976 | Springer et al. | 601/131 |
| 4,813,404 | A | 3/1989 | Vallis | |
| 4,883,380 | A | 11/1989 | Ritterman | |
| 5,125,757 | A * | 6/1992 | Morrison et al. | 401/21 |
| 5,131,384 | A | 7/1992 | Obagi | |
| 5,662,593 | A * | 9/1997 | Tillman et al. | 601/159 |
| 6,010,264 | A | 1/2000 | Scuderi et al. | |
| D426,916 | S | 6/2000 | Ebert | |
| 6,129,469 | A | 10/2000 | Messer et al. | |
| 6,241,696 | B1 * | 6/2001 | York | 601/137 |

* cited by examiner

*Primary Examiner*—Randall Chin

(57) ABSTRACT

A lotion application tool includes a plate having a first side, a second side and a peripheral edge extending between the first and second sides. An elongated handle has a first end that is attached to the peripheral edge. A plurality of balls is extended into and rotatably coupled to the first side. The balls are spaced from each other. A panel has a top surface and a bottom surface. The panel has generally the same size and shape as the first side of the plate. The panel has a plurality of apertures extending therethrough that are each positioned for lining up with and receiving one of the balls when the bottom surface is positioned adjacent to the first side. A fastening member removably fastens the top surface to the first side. Lotion may be positioned on the panel and thereafter applied to a body part.

18 Claims, 3 Drawing Sheets

LOTION APPLICATION TOOL

BACKGROUND OF THE INVENTION

1. Field of the Invention

The present invention relates to lotion application devices and more particularly pertains to a new lotion application device for allowing a person to apply lotion to their entire back without the aid of a second person.

2. Description of the Prior Art

The use of lotion application devices is known in the prior art. U.S. Pat. No. 6,129,469 describes a lotion applicator that includes a reservoir for holding lotion so that the lotion may be ejected out of the head of the device and onto the user. Another type of lotion application device is U.S. Pat. No. 5,125,757 that again includes a reservoir for holding a quantity of lotion which may be selectively applied to the user of a device. Still another lotion application device is U.S. Pat. No. 5,131,384 which includes an applicator with a reservoir as well as a massaging assembly for combining application and massaging into one device.

While these devices fulfill their respective, particular objectives and requirements, the need remains for a device which does not include a reservoir but still allows sufficient application of lotion. The prior generally includes devices which have reservoirs for feeding application balls. However, these devices make it highly difficult for the user to alter the contents of the reservoir so that a different lotion may be applied. A user of these devices may want to place moisturized on their body while their device contains sunscreen lotion, or they wish to use a lotion that has a higher sun blocking ability. What is required is a device that allows a person to quickly change from one lotion to another without concern of cleaning out a reservoir.

SUMMARY OF THE INVENTION

The present invention meets the needs presented above by providing a lotion application panel that is removably positioned on a plate. When a user of the device determines that a different type of lotion is warranted, the panel is removed and replaced with another panel. Lotion may then be positioned on this new panel to be spread onto the body.

To this end, the present invention generally comprises a plate having a first side, a second side and a peripheral edge extending between the first and second sides. An elongated handle has a first end that is attached to the peripheral edge. A plurality of balls is extended into and rotatably coupled to the first side. The balls are spaced from each other. A panel has a top surface and a bottom surface. The panel has generally the same size and shape as the first side of the plate. The panel has a plurality of apertures extending therethrough that are each positioned for lining up with and receiving one of the balls when the bottom surface is positioned adjacent to the first side. A fastening member removably fastens the top surface to the first side. Lotion may be positioned on the panel and thereafter applied to a body part.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
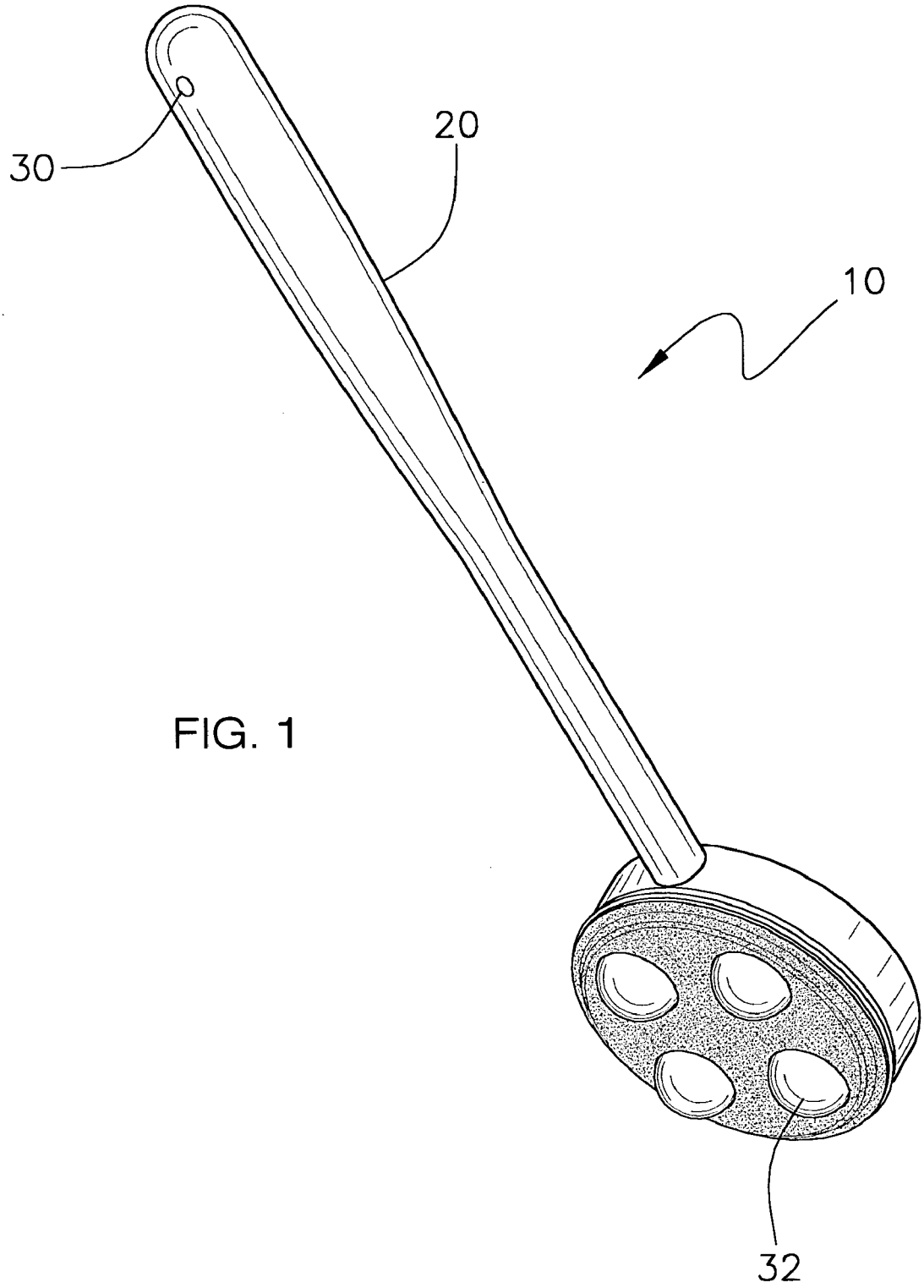
FIG. 1 is a perspective view of a lotion application tool according to the present invention.
Figure 2:
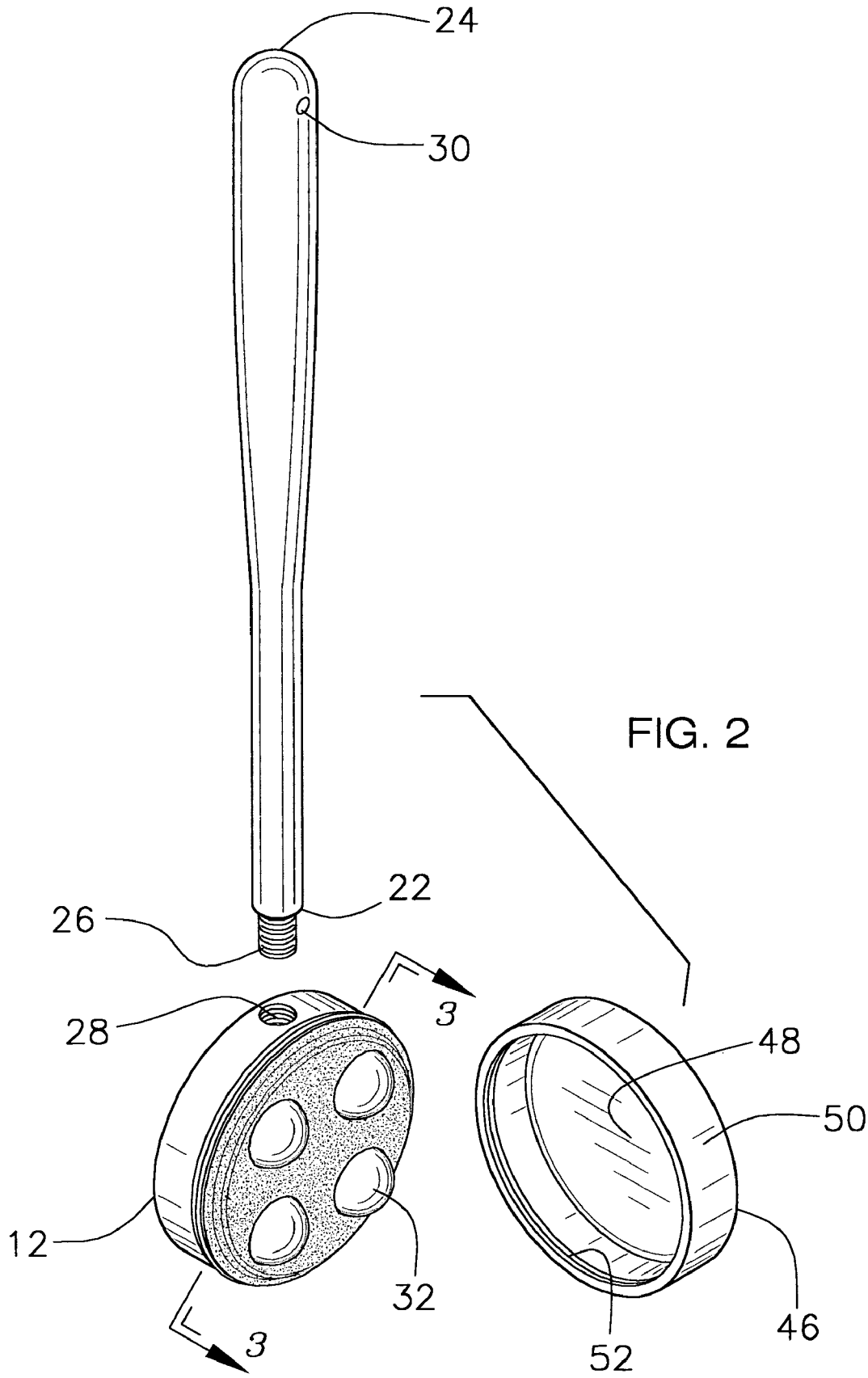
FIG. 2 is a perspective view of the present invention.
Figure 3:
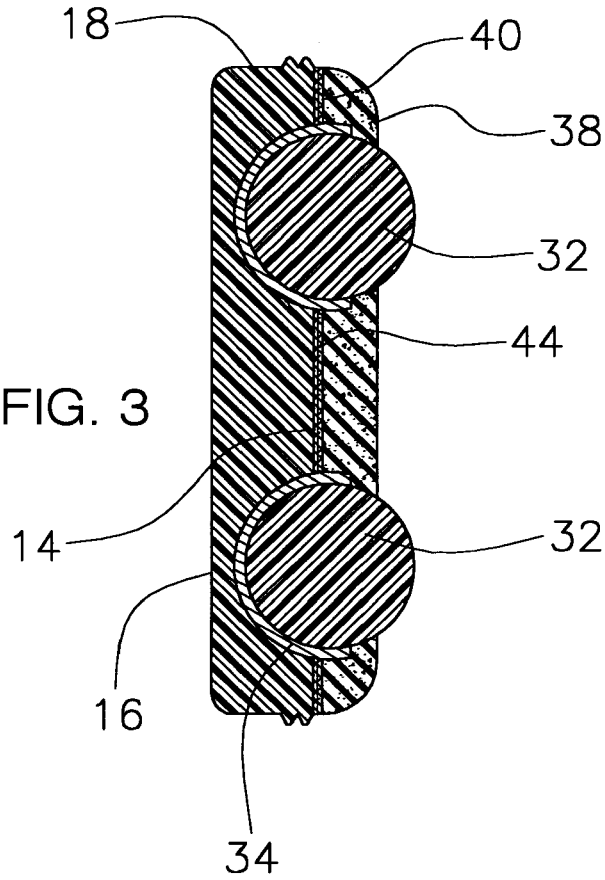
FIG. 3 is a cross-sectional view taken along line 3—3 of FIG. 2 of the present invention.
Figure 4:
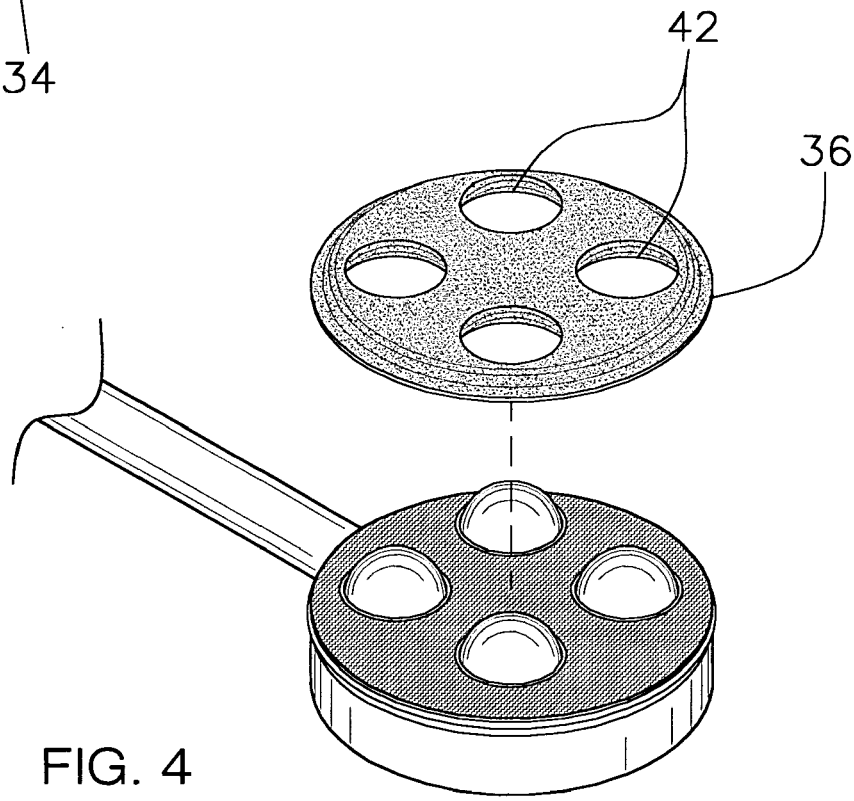
FIG. 4 is a perspective view of the present invention.

With reference now to the drawings, and in particular to FIGS. 1 through 4 thereof, a new lotion application device embodying the principles and concepts of the present invention and generally designated by the reference numeral 10 will be described.

As best illustrated in FIGS. 1 through 4, the lotion application tool 10 generally comprises a tool for selectively spreading lotion, such as moisturizer or sunscreen lotion, on a body part. The tool 10 includes a plate 12 that has a first side 14, a second side 16 and a peripheral edge 18 extending between the first 14 and second 16 sides. The plate 12 has a generally circular shape and the peripheral edge 18 is preferably threaded.

An elongated handle 20 is provided which has a first end 22 and a second end 24. The first end 22 may be permanently attached to the peripheral edge 18 or a securing member may be utilized to removably secure the first end 22 to the peripheral edge 18 of the plate 12. The securing member preferably includes a threaded rod 26 that is attached to and extends away from the first end 22 of the handle 20. The threaded rod 26 is removably extended into and coupled to a threaded well 28 extending into the peripheral edge 18. The handle 12 has an opening 30 extending therethrough that is positioned generally adjacent to the second end 24 of the handle 20. The opening 30 allows the user of the tool 10 to hang the tool 10 on hook.

A plurality of balls 32, or rollers, is extended into and rotatably coupled to the first side 14. The balls 32 are spaced from each other. Preferably, the tool 10 includes a plurality of saddles 34 that are mounted in the first side 14 of the plate 12. Each of the balls 32 is positioned in one of the saddles 34 such that the saddles 34 rotatably couple each of the balls 32 to the plate 12. The balls 32 are preferably comprised of an elastomeric or plastic material for the comfort of the user. Less preferred would be balls 32 comprised of a metallic material.

A panel 36 has a top surface 38 and a bottom surface 40. The panel 36 has generally the same size and shape as the first side 14 of the plate 12. The panel 12 has a plurality of apertures 42 extending therethrough. Each of the apertures 42 is positioned for lining up with and receiving one of the balls 32 when the bottom surface 40 is positioned adjacent to the first side 14. This allows the balls 32 to extend through the panel 36. The panel 36 is comprised an absorbent material such as sponge material. A fastening member removably fastens the bottom surface to the first side 14.

Though snaps or clips could be utilized, it is preferred that the fastening member includes a hook.

A cover 46 may be removably attached to the plate 12. The cover 46 is adapted for covering the first side 14 and the panel 36 attached thereto for preventing any unwanted displacement of material placed on the panel 36. The cover 46 includes an outer wall 48 and a perimeter wall 50 is attached to and extending away from the outer wall 48. The perimeter wall 50 has an inner threaded surface 52 positioned for selectively engaging the threads on the peripheral edge 18 of the plate 12.

In use, lotion is positioned on the panel 36 and thereafter applied to the body part, particularly the back. The balls 32 help in spreading the lotion as well as massaging it into the skin. The handle 20 allows the user to effectively place lotion, such as sunscreen, across their entire back without the help of a second person. The cover 46 can be placed over the first side 14, with the panel 36 still attached to the plate 12, so that the tool 10 can be stored without concern of lotion getting unintentionally spread onto other objects. The cover 46 also prevents the lotion from drying out on the panel 36. The panel 36 may be removed and replaced after it has been used multiple times or when the user wants to apply a different type of lotion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lotion application tool for selectively spreading lotion on a body part, said tool comprising:

a plate having a first side, a second side and a peripheral edge extending between said first and second sides;

an elongated handle having a first end being attached to said peripheral edge;

a plurality of balls being extended into and rotatably coupled to said first side, said balls being spaced from each other;

a panel having a top surface and a bottom surface, said panel having generally the same size and shape as said first side of said plate, said panel having a plurality of apertures extending therethrough, each of said apertures being positioned for lining up with and receiving one of said balls when said bottom surface is positioned adjacent to said first side, said panel consisting of an absorbent material;

a fastening member removably fastens said bottom surface to said first side; and wherein lotion may be positioned on said panel and thereafter applied to the body part.

2. The tool according to claim 1, wherein said plate has a generally circular shape.

3. The tool according to claim 2, wherein said peripheral edge is threaded, a cover being removably attached to said plate and adapted for covering said first side, said cover including an outer wall and a perimeter wall being attached to and extending away from said outer wall, said perimeter wall having an inner threaded surface positioned for selectively engaging said peripheral edge of said plate.

4. The tool according to claim 1, wherein said fastening member includes a hook and loop fastening means.

5. The tool according to claim 4, further including a cover being removably attached to said plate and adapted for covering said first side.

6. The tool according to claim 1, further including a cover being removably attached to said plate and adapted for covering said first side.

7. The tool according to claim 1, further including a plurality of saddles mounted in said first side of said plate, each of said balls being positioned in one of said saddles such that said saddles rotatably couple each of said balls to said plate.

8. The tool according to claim 7, wherein each of said balls is comprised of an elastomeric material.

9. A lotion application tool for selectively spreading lotion on a body part, said tool comprising:

a plate having a first side, a second side and a peripheral edge extending between said first and second sides, said plate having a generally circular shape, said peripheral edge being threaded;

an elongated handle having a first end and a second end, a securing member removably securing said first end to said second end, said securing member including a threaded rod being attached to and extending away from said first end of said handle, said threaded rod being removably extended into and coupled to a threaded well extending into said peripheral edge, said handle having an opening extending therethrough, said opening being positioned generally adjacent to said second end of said handle;

a plurality of balls being extended into and rotatably coupled to said first side, said balls being spaced from each other;

a panel having a top surface and a bottom surface, said panel having generally the same size and shape as said first side of said plate, said panel having a plurality of apertures extending therethrough, each of said apertures being positioned for lining up with and receiving one of said balls when said bottom surface is positioned adjacent to said first side, said panel comprising an absorbent material;

a fastening member removably fastens said bottom surface to said first side, said fastening member including a hook and loop fastening means;

a cover being removably attached to said plate and adapted for covering said first side, said cover including an outer wall and a perimeter wall being attached to and extending away from said outer wall, said perimeter wall having an inner threaded surface positioned for selectively engaging said peripheral edge of said plate; and wherein lotion may be positioned on said panel and thereafter applied to the body part.

10. The tool according to claim 9, further including a plurality of saddles mounted in said first side of said plate, each of said balls being positioned in one of said saddles such that said saddles rotatably couple each of said balls to said plate.

11. The tool according to claim 10, wherein each of said balls is comprised of an elastomeric material.

12. A lotion application tool for selectively spreading lotion on a body part, said tool comprising:

a plate having a first side, a second side and a peripheral edge extending between said first and second sides;

an elongated handle having a first end being attached to said peripheral edge;

a plurality of balls being extended into and rotatably coupled to said first side, said balls being spaced from each other;

a panel having a top surface and a bottom surface, said panel having generally the same size and shape as said first side of said plate, said panel having a plurality of apertures extending therethrough, each of said apertures being positioned for lining up with and receiving one of said balls when said bottom surface is positioned adjacent to said first side;

a fastening member removably fastens said bottom surface to said first side, said fastening member including a hook and loop fastening means;

a cover being removably attached to said plate and adapted for covering said first side; and wherein lotion may be positioned on said panel and thereafter applied to the body part.

13. The tool according to claim 12, wherein said plate has a generally circular shape.

14. The tool according to claim 13, wherein said peripheral edge is threaded, a cover being removably attached to said plate and adapted for covering said first side, said cover including an outer wall and a perimeter wall being attached to and extending away from said outer wall, said perimeter wall having an inner threaded surface positioned for selectively engaging said peripheral edge of said plate.

15. The tool according to claim 12, wherein said panel comprising an absorbent material.

16. The tool according to claim 15, further including a cover being removably attached to said plate and adapted for covering said first side.

17. The tool according to claim 12, further including a plurality of saddles mounted in said first side of said plate, each of said balls being positioned in one of said saddles such that said saddles rotatably couple each of said balls to said plate.

18. The tool according to claim 17, wherein each of said balls is comprised of an elastomeric material.

* * * * *